United States Patent [19]

Bonk

[11] 4,187,960

[45] Feb. 12, 1980

[54] DISPENSER WITH CAP AND PROTECTIVE MEMBER

[75] Inventor: Joseph P. Bonk, Des Plaines, Ill.

[73] Assignee: The Kendall Company, Boston, Mass.

[21] Appl. No.: 928,757

[22] Filed: Jul. 27, 1978

[51] Int. Cl.[2] ..... B65D 35/08

[52] U.S. Cl. ..... 222/107; 222/212; 222/545; 222/568

[58] Field of Search ..... 222/107, 215, 182, 212, 222/568, 545

[56] References Cited

U.S. PATENT DOCUMENTS

| | | | |
|---|---|---|---|
| 2,792,975 | 5/1957 | Yorker | 222/568 X |
| 2,957,501 | 10/1960 | Holmes | 222/212 X |
| 2,957,609 | 10/1960 | Holmes | 222/212 |
| 3,083,877 | 4/1963 | Gash | 222/212 X |
| 3,155,281 | 11/1964 | Stracey | 222/107 |
| 3,473,524 | 10/1969 | Drewe | 222/215 X |

*Primary Examiner*—Allen N. Knowles

*Attorney, Agent, or Firm*—Powell L. Sprunger

[57] ABSTRACT

A dispenser comprising, a receptacle having a container with a plurality of contiguous bellows defining a chamber, a hollow nipple extending distally from the container, and a cap for releasably closing a distal end of the nipple, with a proximal end of the nipple being releasably attached to a distal end of the container. The dispenser has a protective member having sidewalls defining a cavity to receive the nipple and cap in a closure position of the protective member with a proximal end portion of the protective member extending peripherally around the container. The proximal end portion of the protective member is releasably connected to the container at a location proximal the location of attachment between the nipple and container.

3 Claims, 6 Drawing Figures

DISPENSER WITH CAP AND PROTECTIVE MEMBER

BACKGROUND OF THE INVENTION

The present invention relates to dispensers, and more particularly such dispensers which are useful to lubricate catheters.

A various assortment of catheters have been proposed for use in patients. In particular, catheters of the Foley type have been utilized to drain urine from the patient's bladder. During placement, a distal end of the catheter is passed through the urethra until a drainage eye and balloon on the distal end of the catheter are located in the patient's bladder, and the balloon is then inflated to retain the catheter in place. In this configuration, a proximal end of the catheter, which projects from the patient's body, is attached to the distal end of a drainage tube. During catheterization, urine passes from the bladder through the drainage eye, the catheter, and the drainage tube to a drainage bag for retention therein.

Due to the relative sizes of the catheter shaft and the urethra, the physician or attendant commonly applies a lubricant jelly to the catheter shaft before placement of the catheter in order to facilitate passage of the catheter shaft through the urethra. In the past, containers or dispensers retaining the jelly have been utilized to apply the jelly onto the catheter shaft, and commonly both the dispenser and catheter are supplied to the physician in a sterile tray which retains the components necessary for catheterization. However, it has been found that during sterilization of the trays, the dispensers have a tendency to expand due to differential pressures in the dispenser and the remainder of the tray during either gas or heat sterilization procedures. As a result, if the dispensers are bipartate in form, the dispensers are susceptible to leakage during sterilization. Thus, the jelly may pass to remote parts of the tray, as well as the outside of the dispenser itself, resulting in spoilage of the tray, or, at the very least, rendering the tray in a messy and undesirable condition for the physician.

SUMMARY OF THE INVENTION

A principal feature of the present invention is the provision of an improved dispenser for retaining a lubricant jelly.

The dispenser of the invention comprises, a receptacle comprising, a container having a plurality of contiguous bellows defining a chamber, a hollow nipple extending distally from the container, a cap for releasably closing a distal end of the nipple, and means for releasably attaching a proximal end of the nipple to a distal end of the container. The dispenser has a protective member having sidewalls defining a cavity to receive the nipple and cap in a closure position of the protective member with a proximal end portion of the protective member extending peripherally around the container. The dispenser has means for releasably connecting the proximal end portion of the protective member to the container at a location proximal the attaching means in the closure position of the protective member.

A feature of the present invention is that the protective member substantially closes the cavity about the container at a location proximal the attaching means.

Thus, a feature of the present invention is that the protective member prevents the spread of retained lubricant jelly from the dispenser in the event that the receptacle leaks from the attaching means during sterilization procedures.

Another feature of the invention is that the protective member prevents spoiling of remote portions of the tray and the outside of the container by the lubricant jelly during the sterilization procedures.

Yet another feature of the invention is that the protective member may be readily removed from the receptacle at the time of use.

Further features will become more fully apparent in the following description of the embodiments of this invention and from the appended claims.

DESCRIPTION OF THE PREFERRED EMBODIMENTS

Figure 1:
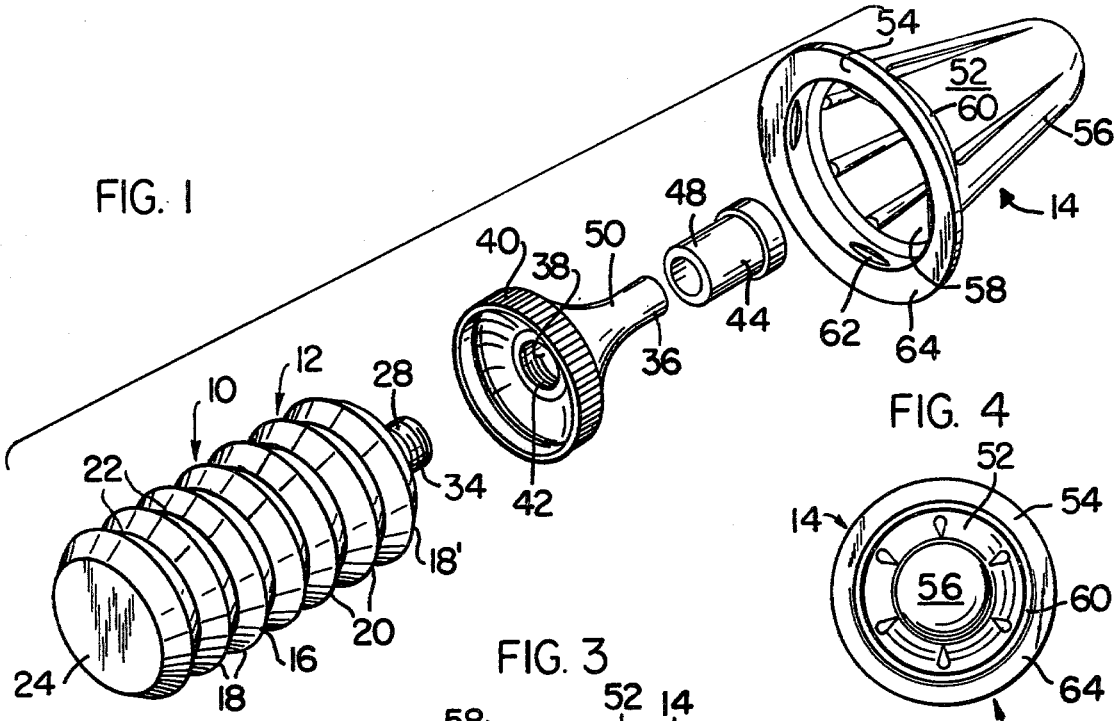
FIG. 1 is an exploded perspective view of a dispenser of the present invention.
Figure 4:
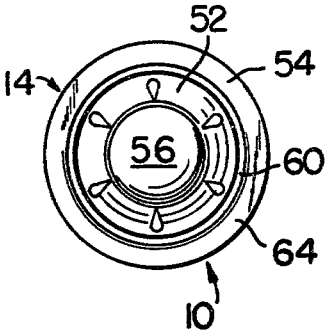
FIG. 4 is a top plan view of the protective member of FIG. 3.
Figure 3:
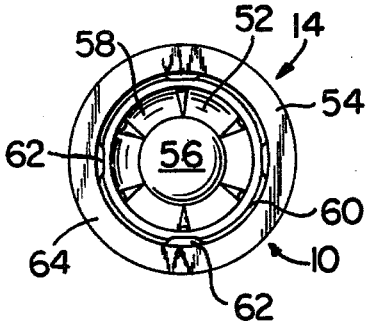
FIG. 3 is a bottom plan view of a protective member for the dispenser of FIG. 1.
Figure 2:
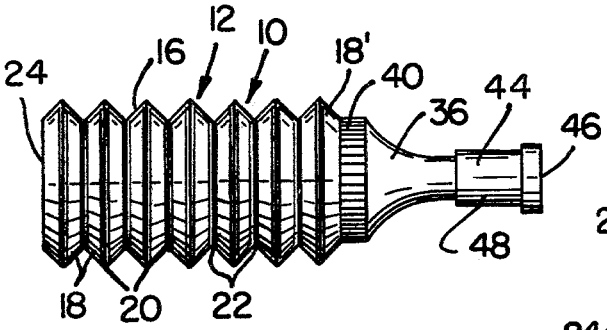
FIG. 2 is a side elevational view of a receptacle for retaining lubricant jelly in the dispenser of FIG. 1.

Referring now to FIGS. 1–5, there is shown a dispenser generally designated 10 comprising a receptacle 12 and a protective member 14. The receptacle 12 has a container 16 having a plurality of longitudinally disposed contiguous bellows 18, with each of the bellows 18 having an outer annular edge 20, and with adjacent bellows 18 being joined together by respective inner annular edges 22. The container 16 also has a bottom wall 24, a top wall 26, and an outlet member 28 extending distally from the top wall 26 and defining an outlet port 30 for the container 16. The bellows 18, bottom wall 24, and top wall 26 define a chamber 32 in the container 16 for retaining a lubricant jelly, with the container 16 being constructed of a suitable flexible material, such as plastic, in order that the bellows 18 may be compressed to dispel the jelly through the outlet port 30 at the time of use. As shown, the outlet member 28 has a plurality of outer threads 34 for a purpose which will be described below.

The receptacle 12 also has an elongated nipple 36 defining a lumen 38 and having an outwardly flared proximal portion 40. The nipple 36 has inner threads 42 at the proximal end of the lumen 38 which cooperate with the threads 34 on the outlet member 28, such that the nipple 36 may be releasably attached to the container 16 through rotation of the nipple 36 relative to the outlet member 28. In this configuration, the outwardly flared proximal portion 40 of the nipple 36 covers the top wall 26 of the container 16. The receptacle 12 also has a cap 44 having an end wall 46 and an annular sidewall 48 which is releasably received on a distal end 50 of the nipple 36 in order to close a distal end of the nipple lumen 38.

Figure 5:
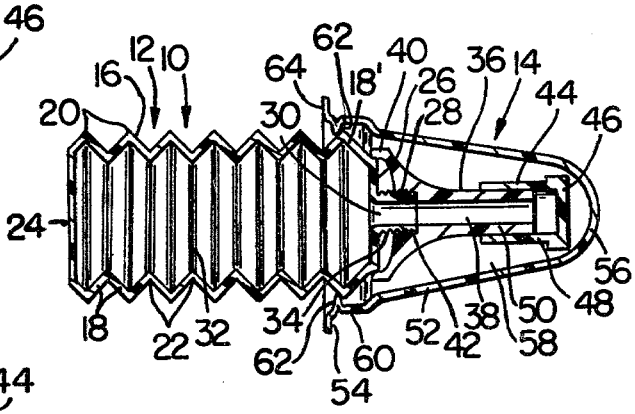
FIG. 5 is a sectional view of the dispenser of FIG. 1 illustrating the protective member in a closure position on the receptacle.

The protective member 14 has a closed peripheral sidewall 52 which is tapered from a proximal end 54 of the protective member 14 toward a curved distal end 56 of the protective member 14, with the sidewall 52 defining a cavity 58 within the protective member 14. As shown, the protective member 14 has an annular member 60 adjacent the proximal end 54 of the protective member, with the annular member 60 having a plurality of inwardly directed bosses 62 spaced peripherally around the annular member 60. The protective member 14 also has an outwardly directed rim 64 extending peripherally around the protective member 14 at the proximal end 54 thereof. With reference to FIG. 5, the protective member 14 may be releasably attached to the container 16 with the bosses 62 of the protective member 14 being received over the outer edge 20 of the most distal bellows 18' in a closure position of the protective member 14. In this configuration, the protective member bosses 62 engage against the wall of the distal bellows 18' at a location proximal the edge 20 of the bellows 18' in order to retain the protective member 14 in place. In addition, the proximal end 54 of the protective member 14 substantially closes the cavity 58 about the container 16 for a purpose which will be described below. The protective member 14 may be made of any suitable flexible material, such as a high impact polystyrene material.

During manufacture, a lubricant jelly may be inserted through the port 30 into the container chamber 32 with the nipple 36 removed from the container 16, and the nipple 36 may then be attached to the container 16 through use of the cooperating threads 34 and 42, with the cap 44 being placed on the distal end 50 of the nipple 36. Next, the protective member 14 may be placed over the nipple 36, and may be releasably attached to the container bellows 18' through use of the protective member bosses 62, as shown in FIG. 5. In this configuration, the dispenser 10 may be placed in a tray along with a catheter for subsequent use in a catheterization procedure.

During sterilization of the tray, it has been found that the receptacle 12 has a tendency to expand due to differential pressures created in the tray relative to the container chamber 32. As a result, the receptacles 12 are frequently found to leak some of the lubricant jelly adjacent the juncture of the container 16 and attached nipple 36 causing possible spreading of the lubricant jelly to remote parts of the tray or the outside of the container 16 itself. As a consequence, the tray may be rendered in a messy and undesirable condition for the physician at the time of use.

Figure 6:
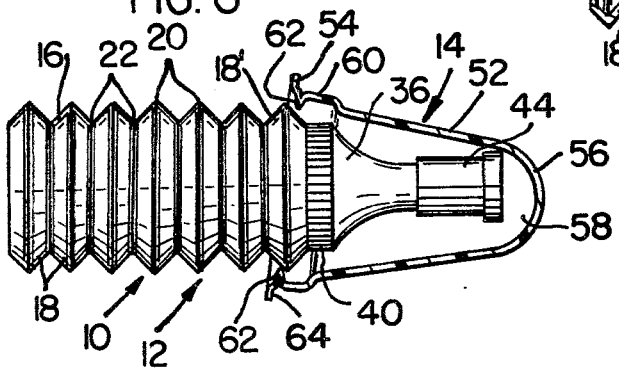
FIG. 6 is an elevational view, taken partly in section, illustrating partial removal of the protective member from the receptacle at the time of use.

However, in accordance with the present invention, the protective member 14 retains all of such leaked jelly within the confines of the closed cavity 58. In this manner, the protective member prevents spreading of the lubricant jelly to remote parts of the tray and the outside of the container 16 in order to provide the physician with the tray in a desired condition for the catheterization procedure. At the time of use, with reference to FIG. 6, the rim 64 may be grasped in order to twist the protective member 14 slightly and disengage the bosses 62 from the distal bellows 18', thus permitting removal of the protective member 14 from the receptacle 12. Next, the cap 44 is removed from the nipple 36, and the physician may squeeze the container 16 to compress the bellows 18 and eject the lubricant jelly onto the catheter shaft to facilitate passage of the catheter shaft through the patient's urethra.

The foregoing detailed description is given for clearness of understanding only, and no unnecessary limitations should be understood therefrom, as modifications will be obvious to those skilled in the art.

I claim:

1. A dispenser, comprising:

a receptacle comprising, a container having a plurality of contiguous bellows defining a chamber and an outer annular edge, a hollow nipple extending distally from said container, a cap for releasably closing a distal end of said nipple, and means for releasably attaching a proximal end of said nipple to a distal end of said container; and a protective member having sidewalls defining a cavity to receive said nipple and cap in a closure position of the protective member with a proximal end portion of the protective member extending peripherally around the container, and means for releasably connecting said proximal end portion of the protective member to said container at a location proximal the attaching means in said closure position and for substantially closing the cavity about the container to prevent leakage from the dispenser, said connecting means comprising a plurality of inwardly directed bosses on said annular member for placement over the outer edge of one of said bellows in said closure position of the protective member.

2. The dispenser of claim 1 wherein said one bellows comprises a most distal bellows in said container.

3. The dispenser of claim 1 wherein said protective member includes an outwardly directed rim extending peripherally around the protective member and located proximal said bosses to facilitate removal of the protective member from the container.

* * * * *